US006557776B2

(12) United States Patent
Carroll, III et al.

(10) Patent No.: US 6,557,776 B2
(45) Date of Patent: May 6, 2003

(54) FUEL INJECTOR WITH INJECTION RATE CONTROL

(75) Inventors: John T. Carroll, III, Columbus, IN (US); Donald J. Benson, Columbus, IN (US); Yul J. Tarr, Columbus, IN (US)

(73) Assignee: Cummins Inc., Columbus, IN (US)

( * ) Notice: Subject to any disclaimer, the term of this patent is extended or adjusted under 35 U.S.C. 154(b) by 18 days.

(21) Appl. No.: 09/907,814

(22) Filed: Jul. 19, 2001

(65) Prior Publication Data

US 2003/0015599 A1 Jan. 23, 2003

(51) Int. Cl.[7] ..... F02D 1/06

(52) U.S. Cl. ..... 239/5; 239/88; 239/96; 239/124; 239/533.3; 239/533.4; 239/533.9

(58) Field of Search ..... 239/88, 90, 96, 239/533.2, 533.3, 533.4, 533.9, 5, 124, 127, 585.1; 123/445, 446, 447, 468, 472

(56) References Cited

U.S. PATENT DOCUMENTS

| | | | |
|---|---|---|---|
| 2,075,949 | A | 4/1937 | Lemon |
| 2,243,011 | A | 5/1941 | L'Orange |
| 2,959,360 | A | 11/1960 | Nichols |
| 3,339,848 | A | 9/1967 | Geiger |
| 4,151,958 | A | 5/1979 | Hofmann |
| 4,168,804 | A | 9/1979 | Hofmann |
| 4,187,825 | A | 2/1980 | Loyd, Jr. |
| 4,200,237 | A | 4/1980 | Urlaub et al. |

(List continued on next page.)

FOREIGN PATENT DOCUMENTS

| | | |
|---|---|---|
| GB | 2 266 559 A | 11/1993 |
| JP | 4-140468 A | 5/1992 |

OTHER PUBLICATIONS

P.L. Herzog et al., "$NO_X$ Reduction Strategies for DI Diesel Engines", SAE Technical Paper No. 920470, (1992), pp. 1–17.

D.R. Coldren et al., "Advanced Technology Fuel System for Heavy Duty Diesel Engines", SAE Technical Paper No. 973182, Nov. 17–19, 1997, pp. 1–11.

* cited by examiner

*Primary Examiner*—Steven J. Ganey
(74) *Attorney, Agent, or Firm*—Nixon Peabody LLP; Tim L. Brackett, Jr.

(57) ABSTRACT

A closed needle injector assembly and method are provided which effectively extending injection duration and improving fueling accuracy at part load conditions, providing a low quantity detached pilot injection at all operating conditions and controlling the duration of, and dwell time between, the pilot injection and one or more higher flow rate primary injections independent of fuel injection pressure. The closed needle injector assembly includes first and second needle valve elements, respective control volumes and a single injection control valve to control the movement of the needle valve elements. A sequencing device is mounted on the injector to permit movement of only the inner needle valve element to define a low fuel injection rate event and permit selectively, controlled movement of both the inner and outer needle valve elements to open positions to define a subsequent primary fuel injection event.

23 Claims, 6 Drawing Sheets

U.S. PATENT DOCUMENTS 4,202,500 A 5/1980 Keiczek
4,215,821 A 8/1980 Eblen
4,269,360 A 5/1981 Kopse
4,284,043 A 8/1981 Happel
4,285,471 A 8/1981 Eblen et al.
4,382,554 A 5/1983 Hofmann
4,546,739 A 10/1985 Nakajima et al.
4,570,853 A * 2/1986 Schmied ..... 239/533.3
4,658,824 A 4/1987 Scheibe
4,736,712 A 4/1988 Savkar et al.
4,758,169 A 7/1988 Steiger
4,826,080 A 5/1989 Ganser
4,856,713 A 8/1989 Burnett
4,958,605 A 9/1990 O'Neal et al.
4,984,738 A 1/1991 Winquist
5,199,398 A 4/1993 Nylund
5,341,783 A 8/1994 Beck et al.
5,458,292 A 10/1995 Hapeman
5,463,996 A 11/1995 Maley et al.
5,535,723 A 7/1996 Gibson et al.
5,588,412 A 12/1996 Nozaki
5,647,316 A 7/1997 Hellén et al.
5,647,536 A 7/1997 Yen et al.
5,676,114 A 10/1997 Tarr et al.
5,711,277 A 1/1998 Fuseya
5,732,679 A 3/1998 Takahasi et al.
5,765,755 A 6/1998 Peters et al.
5,860,597 A 1/1999 Tarr
5,884,611 A 3/1999 Tarr et al.
5,899,389 A 5/1999 Pataki et al.
6,056,264 A 5/2000 Benson et al.
6,155,503 A 12/2000 Benson et al.
6,220,528 B1 * 4/2001 Cooke et al. ..... 239/533.3
6,340,121 B1 * 1/2002 Lambert ..... 239/533.4
6,378,503 B1 * 4/2002 Lambert ..... 123/468
6,471,142 B1 * 10/2002 Lambert ..... 239/88

FUEL INJECTOR WITH INJECTION RATE CONTROL

TECHNICAL FIELD

This invention relates to an improved fuel injector which effectively controls the flow rate of fuel injected into the combustion chamber of an engine.

BACKGROUND OF THE INVENTION

In most fuel supply systems applicable to internal combustion engines, fuel injectors are used to direct fuel pulses into the engine combustion chamber. A commonly used injector is a closed-needle injector which includes a needle assembly having a spring-biased needle valve element positioned adjacent the needle orifices for resisting blow back of exhaust gas into the pumping or metering chamber of the injector while allowing fuel to be injected into the cylinder. The needle valve element also functions to provide a deliberate, abrupt end to fuel injection thereby preventing a secondary injection which causes unburned hydrocarbons in the exhaust. The needle valve is positioned in a needle cavity and biased by a needle spring to block fuel flow through the needle orifices. In many fuel systems, when the pressure of the fuel within the needle cavity exceeds the biasing force of the needle spring, the needle valve element moves outwardly to allow fuel to pass through the needle orifices, thus marking the beginning of injection. In another type of system, such as disclosed in U.S. Pat. No. 5,676,114 to Tarr et al., the beginning of injection is controlled by a servo-controlled needle valve element. The assembly includes a control volume positioned adjacent an outer end of the needle valve element, a drain circuit for draining fuel from the control volume to a low pressure drain, and an injection control valve positioned along the drain circuit for controlling the flow of fuel through the drain circuit so as to cause the movement of the needle valve element between open and closed positions. Opening of the injection control valve causes a reduction in the fuel pressure in the control volume resulting in a pressure differential which forces the needle valve open, and closing of the injection control valve causes an increase in the control volume pressure and closing of the needle valve. U.S. Pat. No. 5,463,996 issued to Maley et al. discloses a similar servo-controlled needle valve injector.

Internal combustion engine designers have increasingly come to realize that substantially improved fuel supply systems are required in order to meet the ever increasing governmental and regulatory requirements of emissions abatement and increased fuel economy. It is well known that the level of emissions generated by the diesel fuel combustion process can be reduced by decreasing the volume of fuel injected during the initial stage of an injection event while permitting a subsequent unrestricted injection flow rate. As a result, many proposals have been made to provide injection rate control devices in closed needle fuel injector systems. One method of controlling the initial rate of fuel injection is to spill a portion of the fuel to be injected during the injection event. For example, U.S. Pat. No. 5,647,536 to Yen et al. discloses a closed needle injector which includes a spill circuit formed in the needle valve element for spilling injection fuel during the initial portion of an injection event to decrease the quantity of fuel injected during this initial period thus controlling the rate of fuel injection. A subsequent unrestricted injection flow rate is achieved when the needle valve moves into a position blocking the spill flow causing a dramatic increase in the fuel pressure in the needle cavity. However, the needle valve is not servo-controlled and, thus, this needle assembly does not include a control volume for controlling the opening and closing of the needle valve. Moreover, the rate shaping needle assembly does not permit the rate to be selectively varied.

Another manner of optimizing combustion is to create pilot and/or post injection events. Most current diesel injectors include fixed needle orifice areas sized to provide optimum injection duration at rated speed and load with the highest allowable injection pressure. However, in order to optimize combustion, pilot and post injection events must include extremely small quantities of fuel at high injection pressures. With a fixed spray orifice size, this results in an extremely short event that is difficult to control. To compensate, the needle opening velocity may be reduced so that the fuel flow is throttled before the spray orifices during the pilot and post injection events. However, needle velocity is not easily controllable from injector to injector, while throttling wastes fuel energy and does not provide optimum combustion performance. At low speed and light load, it is also desirable to have small spray orifices to increase injection duration without lowering injection pressure.

Another fuel injector design providing some limited control over fuel injection rate and quantity includes two needle valve elements for controlling the flow of fuel through respective sets of injection orifices. For example, U.S. Pat. No. 5,458,292 to Hapeman discloses a fuel injector with inner and outer injector needle valves biased to close respective sets of spray holes and operable to open at different fuel pressures. The inner needle valve is reciprocally mounted in a central bore formed in the outer needle valve. However, the opening of each needle valve is controlled solely by injection fuel pressure acting on the needle valve in the opening direction such that the valves necessarily open when the injection fuel pressure reaches a predetermined level. Consequently, the overall and relative timing of opening of the valves, and the rate of opening of the valves, cannot be controlled independently. Moreover, the valve opening timing and rate is dependent on the injection fuel pressure.

U.K. Patent Application No. 2266559 to Hlousek discloses a closed needle injector assembly including a hollow needle valve for cooperating with one valve seat formed on an injector body to provide a main injection through all the injector orifices and an inner valve needle reciprocally mounted in the hollow needle for creating a pre-injection through a few of the injector orifices. However, the valve seat allowing the inner valve needle to block the pre-injection flow is formed on the hollow valve member and the inner valve needle is biased outwardly away from the injector orifices. This arrangement requires a third valve seat for cooperation with the inner valve element when in a pre-injection open position to prevent flow through all of the injector orifices, resulting in an unnecessarily complex and expensive assembly. Also, this assembly is designed for use with two different sources of fuel requiring additional delivery passages in the injector. In addition, like Hapeman, this design requires the timing and rate of opening of at least one of the needle valves to be controlled by fuel injection pressure thereby limiting injection control.

U.S. Pat. No. 5,199,398 to Nylund discloses a fuel injection valve arrangement for injecting two different types of fuels into an engine which includes inner and outer poppet type needle valves. During each injection event, the inner needle valve opens a first set of orifices to provide a preinjection and the outer needle valve opens a second set of orifices to provide a subsequent main injection. The outer poppet valve is a cylindrical sleeve positioned around a stationary valve housing containing the inner poppet valve.

U.S. Pat. No. 5,899,389 to Pataki et al. discloses a fuel injector assembly including two biased valve elements controlling respective orifices for sequential operation during an injection event. A single control volume may be provided at the outer ends of the elements for receiving biasing fluid to create biasing forces on the elements for opposing the fuel pressure opening forces. However, the control volume functions in the same manner as biasing springs to place continuous biasing forces on the valve elements. As a result, the needle valve elements only lift when the supply fuel pressure in the needle cavity is increased in preparation of a fuel injection event to create pressure forces greater than the closing forces imparted by the control volume pressure.

Although some systems discussed hereinabove create different stages of injection, further improvement is desirable. Therefore, there is need for a servo-controlled fuel injector for providing enhanced control over injection timing and flow rate.

SUMMARY OF THE INVENTION

It is an object of the present invention, therefore, to overcome the disadvantages of the prior art and to provide a fuel injector which is capable of effectively and predictably controlling the rate of fuel injection.

It is another object of the present invention to provide a servo-controlled injector capable of effectively providing a dual injection so as to minimize emissions.

It is another object of the present invention to provide a servo-controlled injector assembly capable of selectively providing either a low fuel injection rate followed by a high fuel injection rate or only a single low fuel injection rate.

It is yet another object of the present invention to provide an injector capable of producing multiple injection flow rates from a common source of pressurized fuel without requiring significant variations in the fuel supply pressure.

It is a further object of the present invention to provide an injector for use in a variety of fuel systems, including common rail system and accumulator pump systems, which effectively controls the rate of injection at each cylinder location.

Still another object of the present invention is to provide an injector which is capable of selectively creating different injection rate shapes to optimize emissions and fuel economy.

Yet another object of the present invention is to provide an injector which is compatible with existing pilot activated fuel injection mechanisms and methodologies.

Another object of the present invention is to provide an injector which permits injection duration to be extended and fueling accuracy improved at part load conditions.

Still another object of the present invention is to provide an injector which is capable of producing a low quantity detached pilot injection at all operating conditions.

It is a further object of the present invention to provide an injector wherein the duration of, and the dwell between, a low-flow rate pilot and one or more high-flow rate main injections can be controlled independently of injection pressure.

These and other objects of the present invention are achieved by providing a closed nozzle injector assembly for injecting fuel into the combustion chamber of an engine, comprising a closed nozzle injector assembly for injecting fuel into the combustion chamber of an engine comprising an injector body containing an injector cavity and a plurality of injector orifices communicating with one end of the injector cavity to discharge fuel into the combustion chamber wherein the plurality of injector orifices include a first set of orifices and a second set of orifices. The injector body also includes a fuel transfer circuit for transferring supply fuel to the plurality of injector orifices. A first needle valve element is positioned in the injector cavity for controlling fuel flow through the first set of injector orifices and a first valve seat formed on the injector body. The first needle valve element is movable from a closed position against the first valve seat blocking flow through the first set of injector orifices to an open position permitting flow through the first set of injector orifices. A second needle valve element is positioned in the cavity for controlling fuel flow through the second set of injector orifices and a second valve seat is formed on the injector body. The second valve element is movable from a closed position against the second valve seat blocking flow through the second set of injector orifices to an open position permitting flow through the second set of injector orifices. A first control volume is positioned adjacent an upper end of the first needle valve element for receiving fuel while a second control volume is positioned adjacent an upper end of the second needle valve element for receiving fuel. A drain circuit is provided for draining fuel from the first and the second control volumes to a low pressure drain. An injection control valve is positioned along the drain circuit for controlling the flow of fuel through the drain circuit to permit movement of the first and the second needle valve elements between the open and closed positions. The injection control valve is movable from a closed position to an open position and from the open position to the closed position to define a control event. The injection control valve is operable to create a first control event permitting movement of the first needle valve element to the open position while maintaining the second needle valve element in the closed position to define a low fuel injection rate event. A sequencing means is mounted on the injector body for permitting movement of both the first and the second needle valve elements to respective open positions during a second control event following the first control event to define a primary fuel injection event.

The low fuel injection rate event and the primary fuel injection event both occur at approximately the same predetermined fuel supply pressure. The sequencing means further functions for varying an effective drain flow area in the drain circuit for controlling fuel flow from the second control volume. The sequencing means may be in the form of a shuttle valve. The drain circuit may include a second control volume drain passage for draining fuel from the second control volume. The sequencing means may include an additional second control volume drain passage and be positioned along the additional second control volume drain passage for opening the additional second control volume drain passage to vary the effective drain flow area. The additional second control volume drain passage may include a portion of the first control volume. The first needle valve element may be telescopingly received within a cavity formed in the second needle valve element to form a sliding fit with an inner surface of the second needle valve element. The injector may further include a throttle passage formed in the second needle valve element to restrict fuel flow upstream of the first set of injector orifices during the low fuel injection rate event. The sequencing means or device is preferably mounted on the injector body adjacent the drain circuit.

The present invention is also directed to a method of injecting fuel into the combustion chamber of an engine comprising the steps of providing an injector body containing an injector cavity and a plurality of injector orifices communicating with one end of the injector cavity to discharge fuel into the combustion chamber, wherein the plurality of injector orifices includes a first set of orifices and a second set of orifices. The injector body may include a fuel transfer circuit for transferring supply fuel to the plurality of injector orifices. The method also includes the step of providing a first needle valve element positioned in the cavity for controlling fuel flow through the first set of injector orifices and a first valve seat formed on the injector body. The method may also include the step of providing a second needle valve element positioned in the cavity for controlling fuel flow through the second set of injector orifices and a second valve seat formed on the injector body. The method also includes the steps of providing a first control volume adjacent an upper end of the first needle valve element for receiving fuel and providing a second control volume positioned adjacent an upper end of the second needle valve element for receiving fuel. The method also includes the step of providing a single injection control valve positioned along the drain circuit for controlling the flow of fuel through the drain circuit to permit movement of the first and the second needle valve elements between open and closed positions. The injection control valve may be movable from a closed position to an open position and from the open position to the closed position to define a control event. The method also includes the step of moving the first needle valve element to the open position while maintaining the second needle valve element in the closed position during a first control event to define a low fuel injection rate event and then moving both the first and the second needle valve elements to respective open positions during a second control event following the first control event to define a primary fuel injection event. The low fuel injection rate event and the primary fuel injection rate event may both occur at approximately the same predetermined fuel supply pressure. The method may also include the step of varying an effective drain flow area in the drain circuit for controlling fuel flow from the second control volume to permit the step of moving both the first and second needle valve elements.

DETAILED DESCRIPTION OF THE PREFERRED EMBODIMENT

Figure 1:
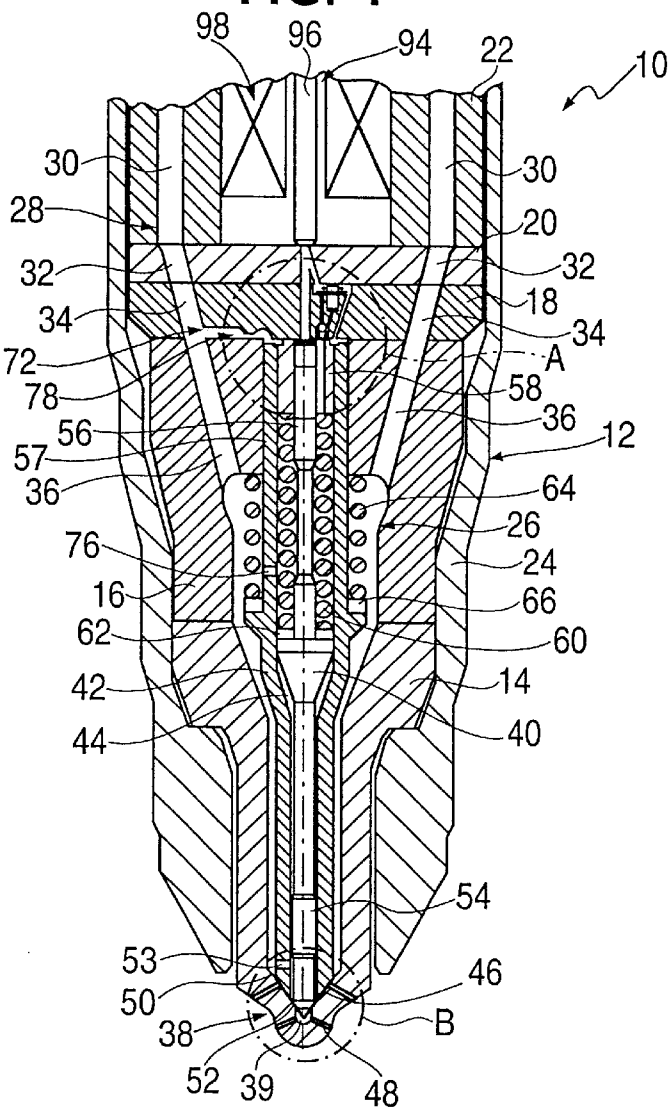
FIG. 1 is an enlarged cross sectional view of the closed nozzle injector of the present invention.

Referring to FIG. 1, there is shown a closed needle injector, indicated generally at 10, which is capable of effectively extending injection duration and improving fueling accuracy at part load conditions, providing a low quantity detached pilot injection at all operating conditions and controlling the duration of, and dwell time between, the pilot injection and one or more higher flow rate primary injections independent of fuel injection pressure. Closed needle injector 10 generally includes an injector body 12 formed from a nozzle housing 14, spring housing 16, lower spacer 18, upper spacer 20, actuator housing 22 and retainer 24 for holding the various components in compressive abutting relationship. For example, retainer 24 may contain internal threads for engaging corresponding external threads on an upper barrel (not shown) to permit the entire injector body 12 to be held together by simple relative rotation of retainer 24 relative to the upper barrel. Injector body 12 includes an injector cavity, indicated generally at 26. Injector body 12 further includes a fuel transfer circuit 28 comprised, in part, of delivery passages 30 formed in actuator housing 22, delivery passages 32 formed in upper spacer 20, transfer passages 34 formed in lower spacer 18 and delivery passages 36 formed in spring housing 16 for delivering fuel from a high pressure source to injector cavity 26. Injector body 12 also includes a plurality of injector orifices 38 fluidically connecting injector cavity 26, including a mini-sac 39, with a combustion chamber of an engine (not shown). Injector 10 is positioned in a receiving bore (not shown) formed in, for example, the cylinder bead of an internal combustion engine.

The closed needle injector 10 of the present invention can be adapted for use with a variety of fuel systems. The present closed needle injector 10 is especially advantageous when used in combination with a fuel system providing fuel from a common pressurized source at a substantially constant pressure, such as a high pressure common rail fuel system or a high pressure accumulator system. However, closed needle injector 10 may also be used in a dedicated pump assembly, such as in a pump-line-nozzle system or a unit injector system incorporating, for example, a mechanically actuated plunger into the injector body. Closed needle injector 10 may also be incorporated into the fuel system disclosed in U.S. Pat. No. 5,676,114 entitled Needle Controlled Fuel System with Cyclic Pressure Generation, the entire contents of which is hereby incorporated by reference. Thus, closed needle injector assembly 10 of the present invention may be incorporated into any fuel injection system which supplies high pressure fuel, and especially those fuel systems which supply fuel at a generally constant high pressure, to fuel transfer circuit 28 while permitting the injector discussed herein below to control the timing, quantity and flow rate of the fuel injected into the combustion chamber.

Closed needle fuel injector 10 also includes a first or inner needle valve element 40 and a second or outer needle valve element 42 both positioned for reciprocal movement within injector cavity 26. Specifically, outer needle valve element 42 has a generally cylindrical shape forming an inner cavity 44 for receiving inner needle valve element 40. Injector orifices 38 include an outer set of orifices 46 and an inner set of orifices 48. An outer valve seat 50 is formed at the lower end of nozzle housing 14 for abutment by the lower end of outer needle valve element 42 when in a closed position so as to prevent fuel flow from injector cavity 26 through outer set of injector orifices 46. An inner valve seat 52 is formed on the inner surface and at the lower end of nozzle housing 14 for abutment by the lower end of inner needle valve element 40 when in a closed position to prevent fuel flow from injector cavity 26 into the inner set of injector orifices 48 via mini-sac 39. Outer valve seat 50 and inner valve seat 52 may be separate portions of a single seating surface to better facilitate manufacturing. A lower guiding surface 54 formed on inner needle valve element 40 is sized to form a close sliding fit with the inner surface of outer needle valve element 42 to provide a guiding function while permitting unhindered reciprocal movement of the needle valve elements. Likewise, an upper guiding surface 56 is formed on inner needle valve element 40 and sized to form a close sliding fit with the inner surface of a floating needle separator 58 positioned within the upper end of outer needle valve element 42 so as to create a fluid seal. Likewise, the outer surface of floating needle separator 58 is sized to form a close sliding fit with the inner surface of outer needle valve element 42 while also creating a fluid seal. Finally, an outer guiding surface 57 of outer needle valve element 42 is sized to form a close sliding fit with the inner surface of spring housing 16.

Closed needle injector assembly 10 also includes a first or inner needle biasing spring 60, i.e. coil spring, positioned within cavity 44 of outer needle valve element 42 for biasing inner needle valve element 40 into the closed position as shown in FIG. 1. The lower end of inner biasing spring 60 engages an inner needle shim or seat 62 positioned in abutment against a land formed on inner needle valve element 40. The upper end of inner needle biasing spring 60 is seated against the lower end of floating needle separator 58. Closed needle injector assembly 10 also includes a second or outer needle biasing spring 64, i.e. coil spring, positioned in injector cavity 26 around the outer surface of outer needle valve element 42. Thus, outer needle biasing spring 64 surrounds inner needle biasing spring 60 and is positioned in overlapping relationship with inner needle biasing spring 60 along the longitudinal axis of the injector. The inner end of outer needle biasing spring 64 engages a shim or seat 66 positioned in abutment against an annular land formed on outer needle valve element 42. The upper end of outer needle biasing spring 64 engages spring housing 16.

Figure 2:
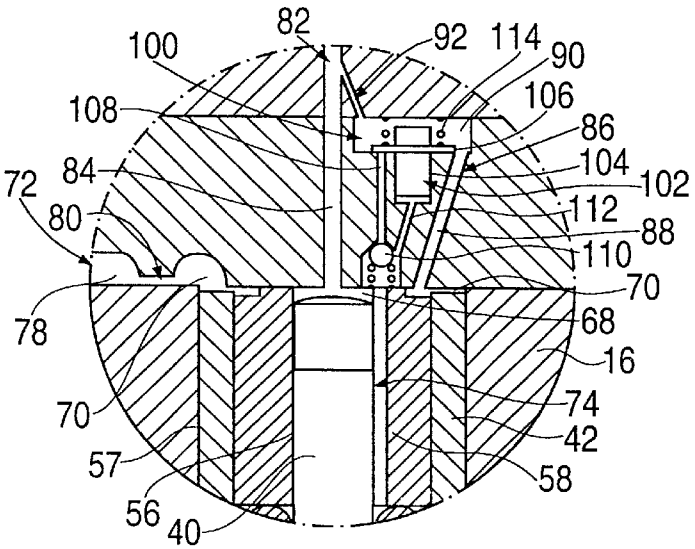
FIG. 2 is an expanded view of the area A of FIG. 1.

Referring to FIG. 2, closed needle injector assembly 10 also includes a first or inner control volume 68 formed within floating needle separator 58 adjacent the upper end of inner needle valve element 40 and a second or outer control volume 70 positioned outside separator 58 adjacent the upper end of outer needle valve element 42. A control volume charge circuit 72 is provided for directing fuel from fuel transfer circuit 28 (FIG. 1) into inner control volume 68 and outer control volume 70. Specifically, control volume charge circuit 72 includes a first charge passage 74 comprised of a slot formed in the inner surface of floating needle separator 58 for delivering supply fuel from inner cavity 44 to inner control volume 68. First charge passage 74 is sized to function as an inner inlet control orifice. It should be noted that supply fuel is delivered from injector cavity 26 to inner cavity 44 via a cross passage 76 formed in outer needle valve element 42. Control volume charge circuit 72 also includes a second charge passage 78 formed in lower spacer 18 for connecting fuel transfer circuit 28 to outer control volume 70. Second charge passage 78 includes an outer inlet control orifice 80. Floating needle separator 58 is maintained in sealing abutment against the lower surface of lower spacer 18 by inner biasing spring 60.

Closed needle injector assembly 10 also includes a drain circuit, indicated generally at 82, for draining fuel from inner control volume 68 and outer control volume 70 to a low pressure drain. Specifically, drain circuit 82 includes a first drain passage 84 formed in lower spacer 18 and upper spacer 20 for draining fuel from inner control volume 68. First drain passage 84 is sized to function as an inner outlet control orifice. Drain circuit 82 also includes a second or outer control volume drain passage 86 for draining fuel from outer control volume 70. In the exemplary embodiment shown in FIG. 2, outer control volume drain passage 86 includes a first passage 88 extending upwardly through lower spacer 18 to communicate with a recess 90 formed in the upper surface of lower spacer 18. Outer control volume drain passage 86 also includes a diagonal passage 92 extending through upper spacer 20 to communicate recess 90 with first drain passage 84. Diagonal passage 92 is sized to function as an outer outlet control orifice.

Closed needle injector assembly 10 of the present invention also includes an injection control valve, indicated generally at 94, positioned along drain circuit 82 downstream of the intersection of diagonal passage 92 and first drain passage 84 for controlling the flow of fuel through drain circuit 82 so as to permit the controlled movement of inner needle valve element 40 and outer needle valve element 42 as described hereinbelow. Injection control valve 94 includes a control valve member 96 biased into a closed position against a valve seat formed on upper spacer 20. Injection control valve 94 also includes an actuator assembly 98 capable of selectively moving control valve member 96 between open and closed positions. For example, actuator assembly 98 may be a fast proportional actuator, such as an electromagnetic, magnetostrictive or piezoelectric type actuator. Actuator assembly 98 may be a solenoid actuator assembly such as disclosed in U.S. Pat. No. 6,056,264 or 6,155,503, the entire contents of both of which are incorporated herein by reference.

Figure 3:
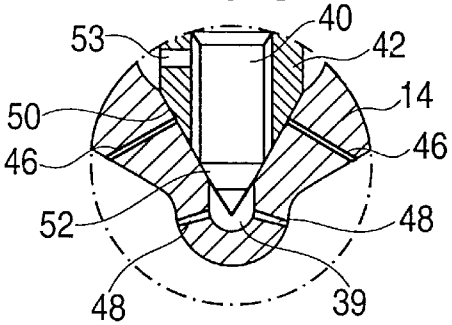
FIG. 3 is an expanded view of the area B of FIG. 1.

A throttle or pilot passage 53 (FIG. 3) is formed in outer needle valve element 42 to restrict fuel flow upstream of inner injector orifices 48 when inner needle valve element 40 moves into the open position. Throttle passage 53 extends transversely through outer needle valve element 42 to fluidically connect an outer supply cavity to an inner supply cavity formed between inner needle valve element 40 and outer needle valve element 42. Throttle passage 53 is sized relative to the total flow area of inner injector orifices 48 to produce a flow induced pressure drop upstream of inner injector orifices 48 in the inner supply cavity. The pressure drop and thus the corresponding lower fuel pressure in the inner supply cavity improves the closing responsiveness of inner needle valve element 40 during low quantity fuel injections.

Importantly, closed needle fuel injector 10 of the present invention includes a sequencing device 100 for permitting sequenced control of inner needle valve element 40 and outer needle valve element 42 using only one injection control valve 94. As a result, sequencing device 100 permits inner needle valve element 40 to be opened and closed to form a low quantity detached pilot injection at all operating conditions while permitting a subsequent higher flow rate primary injection through the opening of both inner needle valve element 40 and outer needle valve element 42 while controlling the duration of the pilot or low fuel injection event and the primary injection event and controlling the dwell time between the events independent of injection pressure.

Sequencing device 100 includes a shuttle valve 102 in the form of a plunger mounted for reciprocal movement in a plunger bore 104. Shuttle valve 102 includes a valve surface 106. Sequencing device 100 further includes an additional second control volume drain passage 108 opening at one end into recess 90 and at an opposite into inner control volume 68. A check valve 110 is positioned along additional second control volume drain passage 108 to permit flow from recess 90 to inner control volume 68 while preventing flow from inner control volume 68 to recess 90 via additional second control volume drain passage 108. A branch passage 112 communicates with additional second control volume drain passage 108 downstream of check valve 110 and with plunger bore 104 at one end of shuttle valve 102 opposite recess 90. A coil spring 114 is positioned in recess 90 to bias shuttle valve 112 into a closed position wherein valve surface 106 blocks flow through additional second control volume drain passage 108. As described hereinbelow, sequencing device 100 further functions to achieve the above advantages by varying the effective flow area from outer control volume 70. The operation and benefits of sequencing device 100 should become apparent from the following discussion of the operation of the device.

Figure 4A:
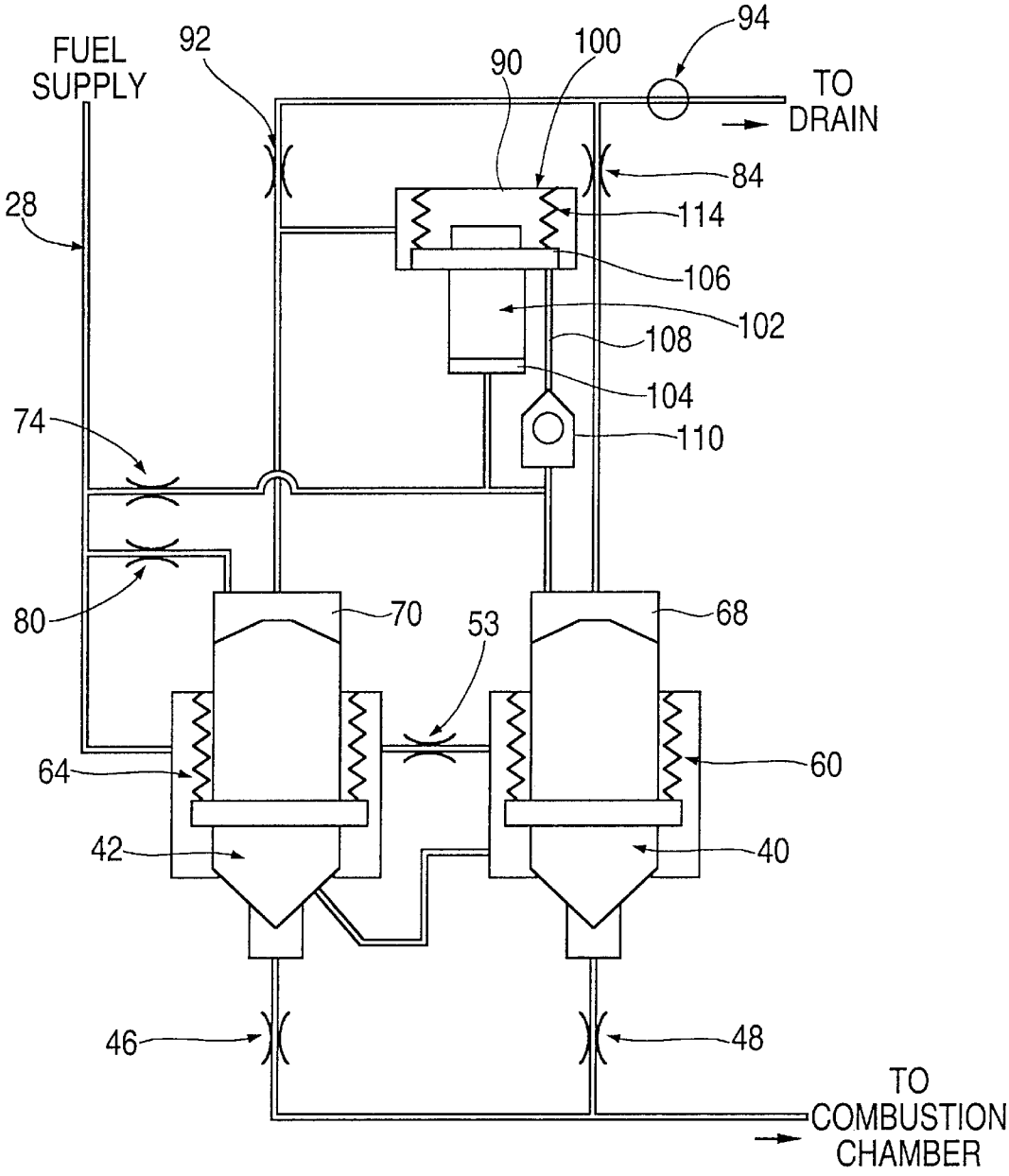
FIGS. 4*a*–4*m* are schematic diagrams of the fuel flow paths and injector components of the injector of FIG. 1.

FIGS. 4*a*–4*m* illustrate the sequence of operations as the injector of the present invention is controlled to produce a low flow rate fuel injection event through inner orifices 48 followed by a higher primary fuel injection event through both the inner and outer orifices 48 and 46, respectively. The control voltage, valve positions, control volume pressures and injection rates during each sequence of operation shown in FIGS. 4*a*–4*m* are represented in FIG. 5 and indicated with corresponding reference letters. FIG. 4*a* illustrates injector 10 in an initial pressurized state. A source of pressurized fuel is supplied to fuel transfer circuit 28 while injection control valve 94 is in its normally closed position, i.e. actuator assembly 98 (FIG. 1) de-energized. Hydraulic forces are developed on the active surfaces of inner needle valve element 40 and outer needle valve element 42 (i.e., surfaces not excluded within the respective valve seat areas). A combination of pressure proportional hydraulic force and fixed return spring pre-load maintains each needle valve element in its normally closed position and ensures that sufficient seating force is generated at the seat to prevent seat leakage. Thus, the high pressure fuel in inner control volume 68 and outer control volume 70 along with the force of the bias springs maintains the valve elements in their respective closed positions. Also, shuttle valve 102 is maintained in the closed position blocking flow through additional second control volume drain passage 108.

Figure 4B:
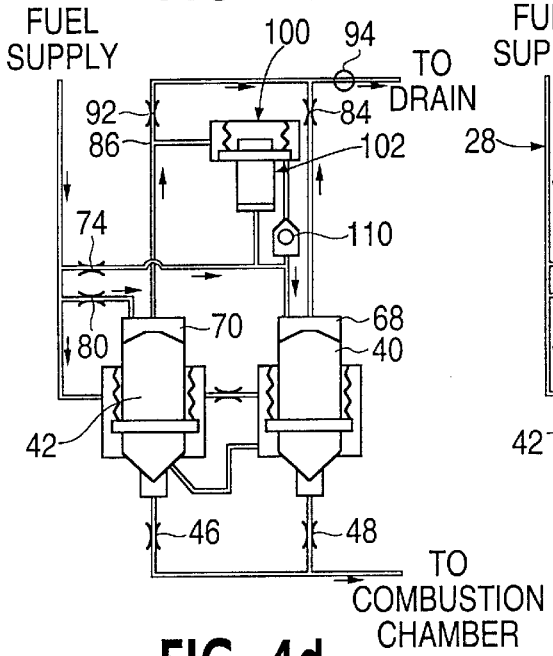
Figure 4C:
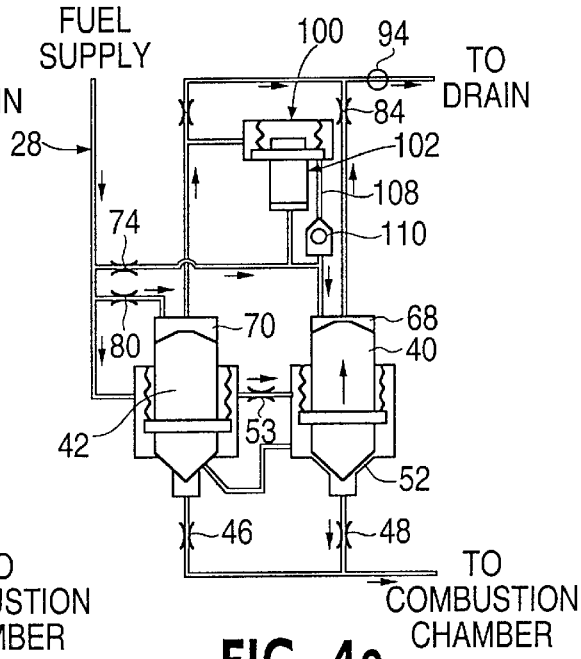
Figure 4D:
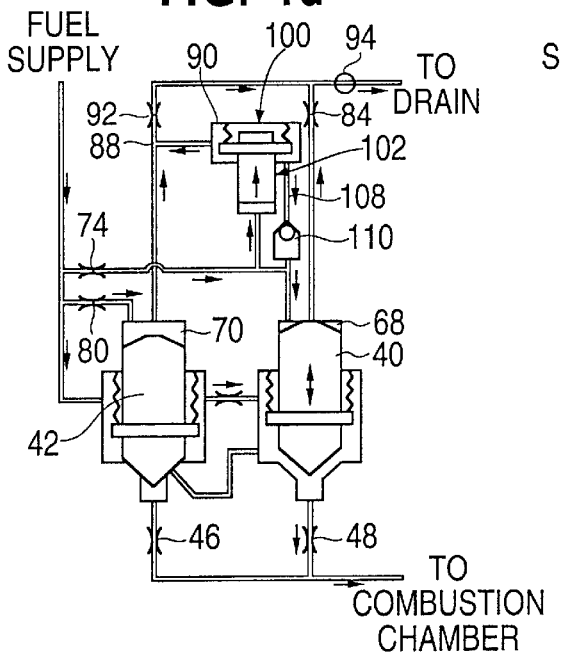
Figure 5:
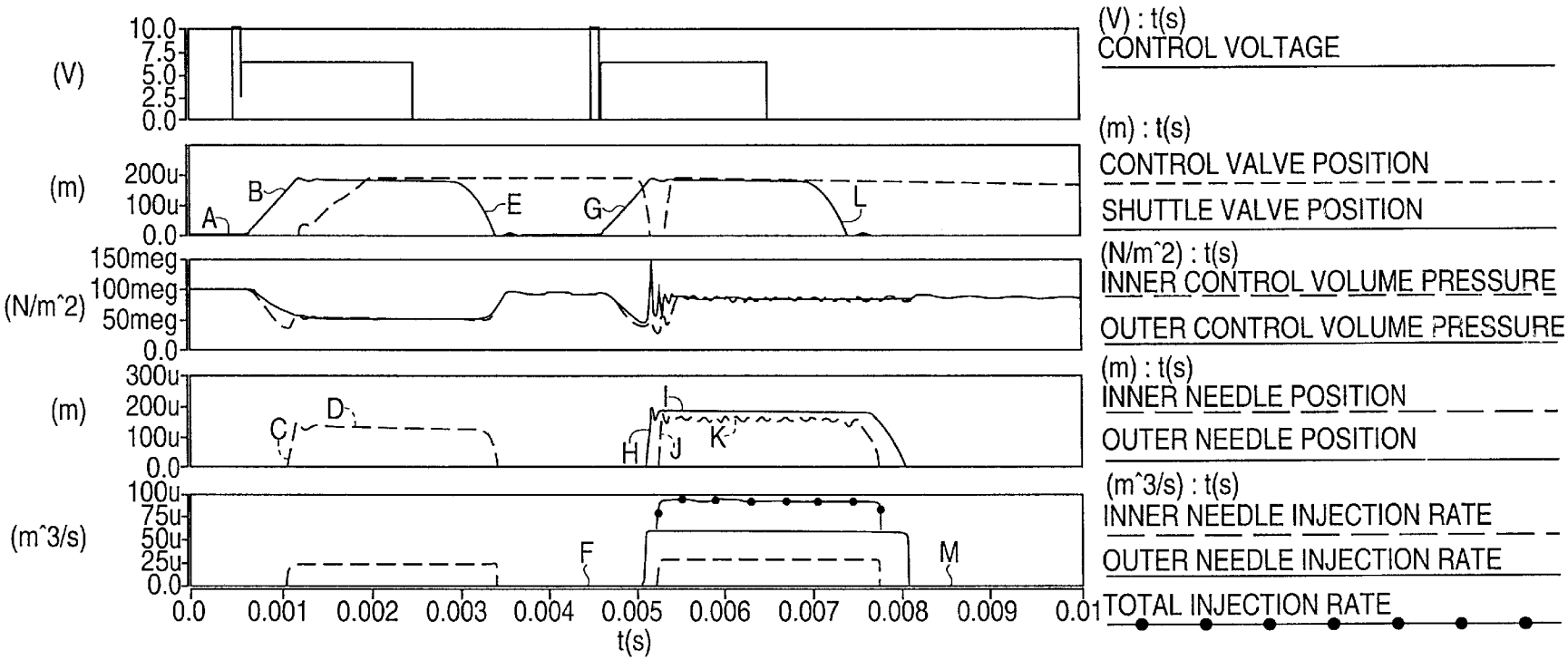
FIG. 5 is a graph showing actuator control voltage, control valve position, shuttle valve position, inner and outer needle position, inner control volume pressure, outer control volume pressure, inner needle injection rate and outer needle injection rate versus time during a typical high pressure injection event with the injector of the present invention.

FIG. 4*b* illustrates the first opening of injection control valve 94. Upon opening, fuel pressure in both control volumes 68 decreases as fuel flows through first drain passage 84 from inner control volume 68 and through outer outlet control orifice 92 of outer control volume drain passage 86. Outer inlet control orifice 80 and first charge passage 74 are both sized to be more restrictive than the respective outlet control orifices 84 and 92, respectively, to prevent repressurization of the respective control volumes. However, as between the outer and inner control orifices, outer inlet control orifice 80 is less restrictive than inner inlet control orifice 74 and outer outlet control orifice 92 is relatively more restrictive than inner outlet control orifice 84. This combination of relatively less restrictive outer inlet orifice 80 and relatively more restrictive outer outlet control orifice 92 produces a relatively higher outer control volume pressure than the pressure in inner control volume 68. As a result, the higher pressure increases the net force acting to maintain the outer needle valve element 42 in its normally closed position than the pressure acting on inner needle valve element 40 in inner control volume 68. The difference between outer and inner control volume pressures also increases the net force acting to maintain shuttle valve 102 in its normally closed position. Referring to FIG. 4*c,* as the fuel pressure in inner control volume 68 decreases, the net force acting to maintain inner needle valve element 40 in its normally closed position reverses direction and acts to lift inner needle valve element 40 toward an open position. The difference between supply and control volume pressures required to initiate needle lift is determined by design parameters affecting needle active area ratio and return spring pre-load. As inner needle valve element 40 lifts toward an open position, fuel flows from fuel transfer circuit 28 through throttle passage 53, across inner valve seat 52 and through inner spray orifices 48 into the combustion chamber. Referring to FIG. 4*d,* once in the open position, inner needle valve element 40 hovers in a state of force equilibrium near its upper stop (the lower surface of lower spacer 18—FIG. 1). Force equilibrium is established and maintained by the inner needle valve element 40 as it restricts flow to inner outlet control orifice 84. When the equilibrium is disturbed so as to cause inner needle valve element 40 to move toward the upper stop, the flow restriction across the top of inner needle valve element 40 increases, correspondingly increasing the inner control volume pressure and resulting hydraulic force imbalance tending to close inner needle valve element 40. Conversely, as the equilibrium is disturbed so as to cause inner needle valve element 40 to move away from the upper stop, the flow restriction decreases, correspondingly decreasing inner control volume pressure and the resulting hydraulic force imbalance tending to close inner needle valve element 40. Inner needle hovering minimizes control flow to drain and the associated energy loss. Inner needle hovering also maintains much of inner control volume 68 in a pressurized state during the injection process to improve closing responsiveness. This elevated pressure causes shuttle valve 102 to lift and open additional second control volume drain passage 108 thereby connecting inner control volume 68 and outer control volume 70 via first passage 88 and recess 90. Check valve 110 prevents flow toward outer control volume 70 which would interfere with shuttle valve 102 being quickly moved to its upper stop and firmly held in the fully open position for the duration of the injection.

Figure 4E:
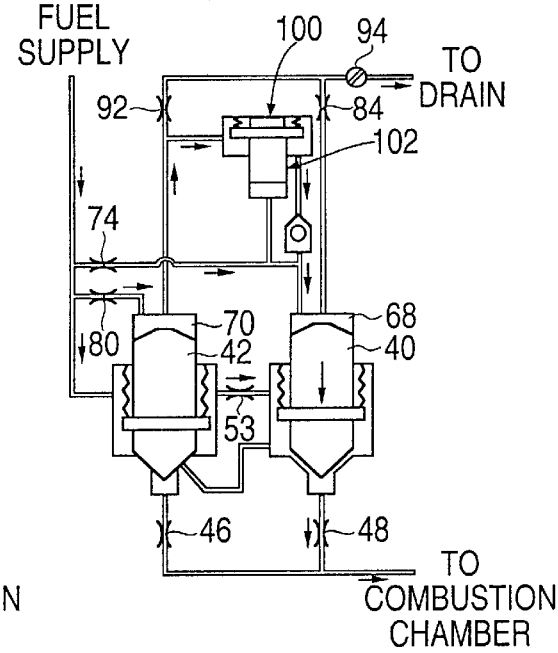
Figure 4F:
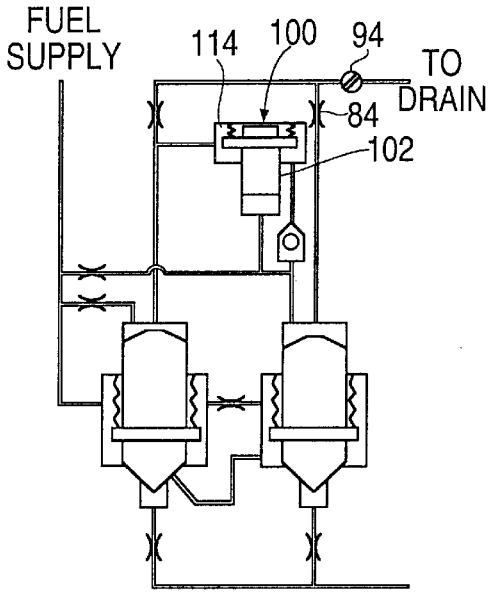
Figure 4G:
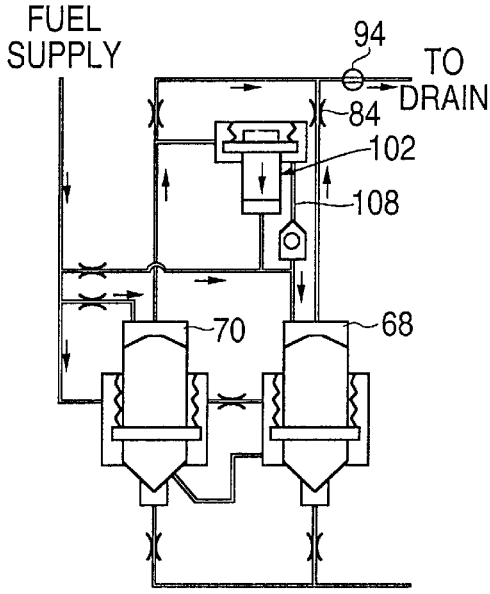

At a predetermined time, injection control valve 94 is moved to the closed position as shown in FIG. 4*e* by, for example, de-energizing actuator assembly 98 (FIG. 1). Closing of injection control valve 94 terminates the low fuel injection rate event or pulse by repressurizing the control volumes to the supply pressure level and reestablishing the net force to seat inner needle valve element 40. For a brief period of time following the repressurization of the control volumes, shuttle valve 102 remains against its upper stop as shown in FIG. 4*e* because the stopped face of shuttle valve 102 is excluded from being an active area on which the suddenly higher fuel pressure can act. The biasing force of coil spring 114 is insufficient to overcome the hydraulic forces acting on shuttle valve 102. FIG. 4*f* illustrates the first dwell period during which no injection occurs. During this no-injection dwell period, both needle valve elements are seated in the closed position and shuttle valve 102 is temporarily held against its upper stop. Maximum available dwell period is determined by the time it takes for pressurized fuel to infiltrate between shuttle valve 102 and its upper stop. Once infiltration has occurred, shuttle valve 102 quickly returns to its original seated, closed position, driven by its return coil spring 114 thereby reestablishing the operational state shown in FIG. 4*a.* In this manner, it is possible to produce a single, low fuel injection flow rate event or pulse of a desired duration during each operating cycle. Referring to FIG. 4*g,* the end of the first no-injection dwell period is marked by the beginning of a primary fuel injection event initiated by a second opening of injection control valve 94. Opening of injection control valve 94 reduces the fuel pressure in both inner control volume 68 and outer control volume 70 as previously described (FIG. 4*b*). However, the second opening of injection control valve 94 occurs with shuttle valve 102 in its open position prior to infiltration of the pressurized fuel between shuttle valve 102 and its upper stop. As a result, an additional path or connection to drain is provided by additional second control volume drain passage 108 and inner control volume 68. The additional drain path increases the effective drain flow area in the drain circuit from outer control volume 70 allowing the fuel pressure in outer control volume 70 to decrease below the level previously achieved when shuttle valve 102 was closed (FIG. 4*b*). The additional drain path also tends to equalize the pressure in inner control volume 68 and outer control volume 70 resulting in a lower pressure level than the pressure level of the fuel originally trapped between shuttle valve 102 and its upper stop thereby causing shuttle valve 102 to begin to return to its closed seated position.

Figure 4H:
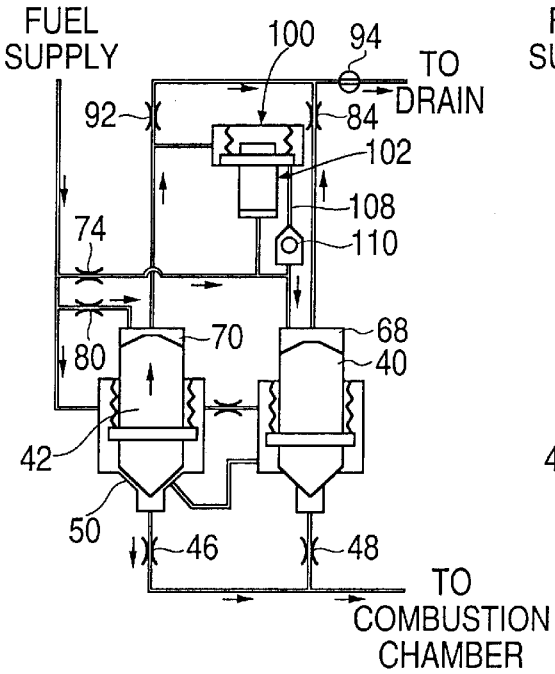

FIG. 4*h* illustrates the first lift of outer needle valve element 42. With a sufficiently low outer control volume pressure, outer needle valve element 42 begins to move toward the open position for the first time. However, because inner and outer control volume pressures are equalized, movement of inner needle valve element 40 is also possible. From the standpoint of maximizing fuel delivery rate, it is desirable to have outer needle valve element 42 lift first to initiate a high rate fuel injection event or pulse and to have inner needle valve element 40 lift immediately after the opening of outer needle valve element 42. In this case, the inner control volume pressure trigger value is intentionally set at a slightly lower pressure than the outer control volume trigger pressure value to allow outer needle valve element 42 to respond first. If a gradual or soft start to a high rate fuel injection event is desirable, inner needle valve element 40 can alternatively be set to lift first. In either case, outer needle valve element 42 must lift away from outer valve seat 50 and expose its seat area to supply pressure before shuttle valve 102 can return to its seated, closed position. Once the outer needle valve element seat area becomes fully exposed to supply pressure at a small fraction of its total lift height, outer needle valve element 42 will open fully regardless of the position of shuttle valve 102.

Figure 4I:
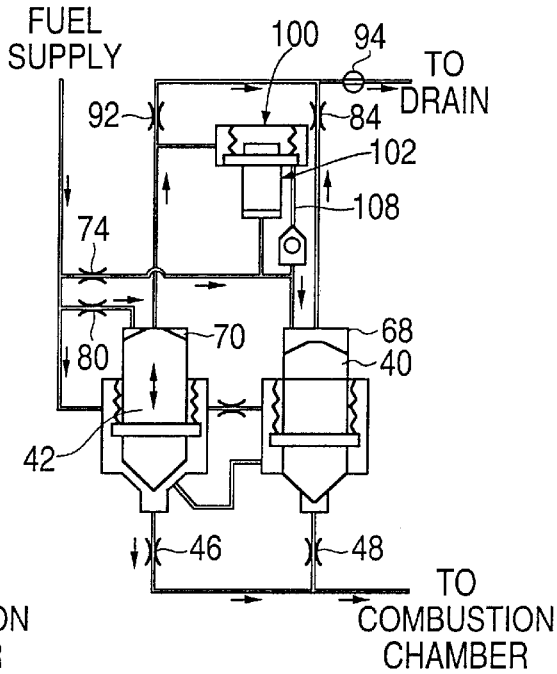
Figure 4J:
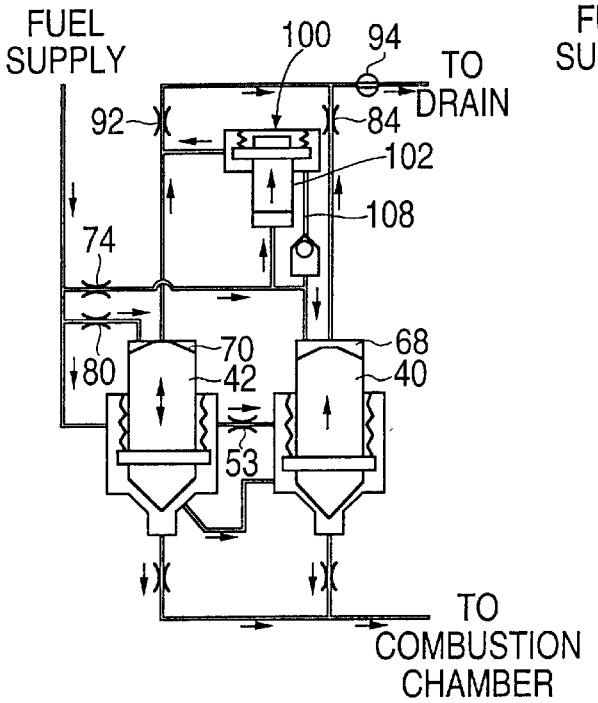
Figure 4K:
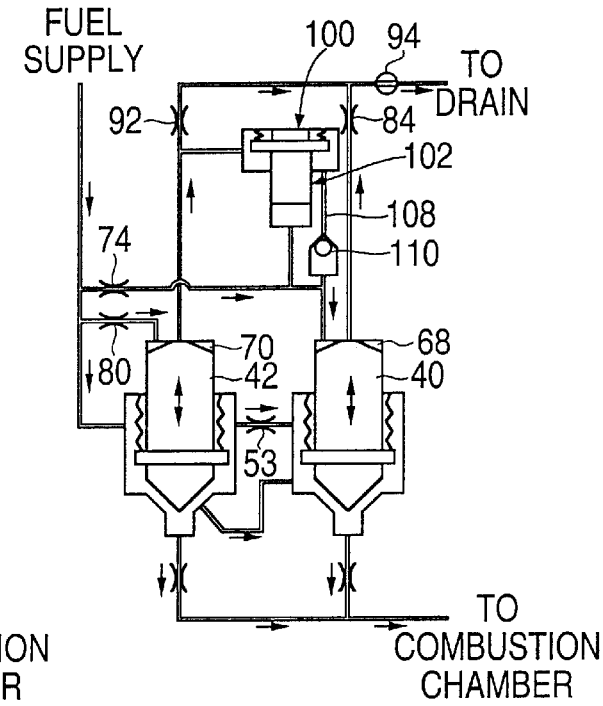
Figure 4L:
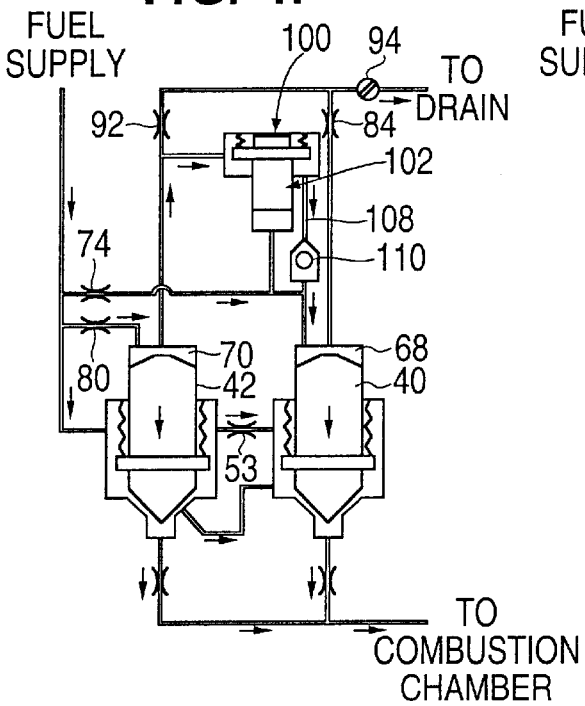
Figure 4M:
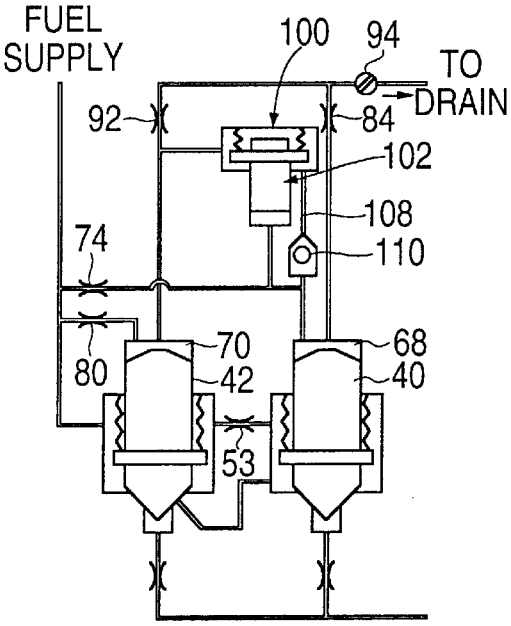

Referring to FIG. 4*i*, outer needle valve element 42 hovers in a state of force equilibrium near its upper stop. Force equilibrium is established and maintained by outer needle valve element 42 as it restricts flow to outer outlet control orifice/diagonal passage 92. When the equilibrium is disturbed so as to cause outer needle valve element 42 to move toward its stop, the flow restriction across the top of outer needle valve element 42 increases, correspondingly increasing the fuel pressure in outer control volume 70 and the resulting hydraulic force imbalance tending to close outer needle valve element 42. Conversely, as the equilibrium is disturbed so as to cause outer needle valve element 42 to move away from its upper stop, the flow restriction decreases, correspondingly decreasing the fuel pressure in outer control volume 70 and the resulting hydraulic force imbalance tending to close outer needle valve element 42. Outer needle hovering minimizes control flow to drain and the associated energy loss, while maintaining much of the outer control volume 70 in a pressurized state during the injection process to improve closing responsiveness. With outer needle valve element 42 hovering and the associated control flow minimized, the fuel pressure in inner control volume 68 is further reduced to the point of triggering lifting or opening of inner needle element 40. As the inner control flow is restricted by the lifting of inner needle valve element 40, the fuel pressure in inner control volume 68 increases and shuttle valve 102 is lifted from its seated, closed position as shown in FIG. 4*j*. Inner needle valve element 40 then resumes its previously described hovering mode of operation and the increased pressure in inner control volume 68 functions to lift shuttle valve 102 as shown in FIG. 4*k*. Check valve 110 again prevents flow toward outer control volume 70 thereby allowing shuttle valve 102 to quickly move to its upper stop. Without check valve 110, the reverse flow of fuel may interfere with the movement of shuttle valve 102 and the ability to hold shuttle valve 102 against its upper stop for the duration of the injection. Referring to FIG. 4*l*, after a predetermined period of time, injection control valve 94 is closed, i.e. actuator assembly 98 (FIG. 1) de-energized, thereby terminating the combined inner plus outer needle valve element injection event (primary injection event) by repressurizing inner control volume 68 and outer control volume 70 to the supply pressure level and reestablishing net forces to seat valve elements 40, 42. For a brief period of time following the repressurization of control volume 68, 70, shuttle valve 102 again remains on its upper stop because the stopped face is excluded from being an active area on which the suddenly higher pressure can act. With both needle valve elements 40, 42 again seated in the closed position and shuttle valve 102 temporarily held against its upper stop, the previously described condition of no-injection dwell occurs as shown in FIG. 4*m*. From this condition another high flow rate fuel injection event/pulse can be initiated by reopening of injection control valve 94 (FIG. 4*g*). Alternatively, sufficient time can be allowed to pass during which pressurized fuel can infiltrate between shuttle valve 102 and its upper stop to reset the injector for a low fuel injection flow rate event/pulse. In the case that the latter option is pursued, injection control valve 94 can be momentarily opened to expedite the resetting of shuttle valve 102 without lifting either needle valve element 40, 42. In applications where the supply pressure varies significantly, another option would be to take advantage of the cyclically varying supply pressure to place shuttle valve 102 in hydraulic equilibrium and allow bias spring 114 to reliably reseat shuttle valve 102 in the closed position prior to the next fuel injection cycle.

It should be noted that the independently adjustable return spring pre-loads, in combination with needle area ratios and control orifice flow coefficients, determine the opening pressure threshold and response characteristics for each needle valve element. Inner needle valve element 40 is of a conventional SAC type design whereas outer needle valve element 42 is a valve covered orifice (VCO) design. The number and size of orifices specified for inner orifices 48 and outer orifices 46 are selected to provide reduced fuel injection rates when inner needle valve element 40 operates alone and conventional rates when both valve elements 40, 42 are operated as described hereinabove.

INDUSTRIAL APPLICABILITY

It is understood that the present invention is applicable to all internal combustion engines utilizing a fuel injection system and to all closed nozzle injectors and especially applicable to fuel injection systems supplied with high pressure fuel at substantially constant pressure. This invention is particularly applicable to diesel engines which require accurate fuel injection rate control by a simple rate control device in order to minimize emissions. Such internal combustion engines including a fuel injector in accordance with the present invention can be widely used in all industrial fields and non-commercial applications, including trucks, passenger cars, industrial equipment, stationary power plant and others.

We claim:

1. A closed needle injector assembly for injecting fuel into the combustion chamber of an engine, comprising:

an injector body containing an injector cavity and a plurality of injector orifices communicating with one end of said injector cavity to discharge fuel into the combustion chamber, said plurality of injector orifices including a first set of orifices and a second set of orifices, said injector body including a fuel transfer circuit for transferring supply fuel to said plurality of injector orifices;

a first needle valve element positioned in said injector cavity for controlling fuel flow through said first set of injector orifices and a first valve seat formed on said injector body, said first needle valve element movable from a closed position against said first valve seat blocking flow through said first set of injector orifices to an open position permitting flow through said first set of injector orifices;

a second needle valve element positioned in said injector cavity for controlling fuel flow through said second set of injector orifices and a second valve seat formed on said injector body, said second valve element movable from a closed position against said second valve seat blocking flow through said second set of injector orifices to an open position permitting flow through said second set of injector orifices;

a first control volume positioned adjacent an upper end of said first needle valve element for receiving fuel;

a second control volume positioned adjacent an upper end of said second needle valve element for receiving fuel;

a drain circuit for draining fuel from said first and said second control volumes to a low pressure drain;

an injection control valve positioned along said drain circuit for controlling the flow of fuel through said drain circuit to permit movement of said first and said second needle valve elements between said open and said closed positions, said injection control valve movable from a closed position to an open position and from the open position to the closed position to define a control event, said injection control valve operable to create a first control event permitting movement of said first needle valve element to the open position while maintaining said second needle valve element in said closed position to define a low fuel injection rate event; and a sequencing means mounted on said injector body for permitting movement of both said first and said second needle valve elements to respective open positions during a second control event following said first control event to define a primary fuel injection event.

2. The injector of claim 1, wherein said low fuel injection rate event and said primary fuel injection event both occur at approximately the same predetermined fuel supply pressure.

3. The injector of claim 1, wherein said sequencing means further functions for varying an effective drain flow area in said drain circuit for controlling fuel flow from said second control volume.

4. The injector of claim 3, wherein said drain circuit includes a second control volume drain passage for draining fuel from said second control volume, said sequencing means including an additional second control volume drain passage and further functioning for controlling the opening of said additional second control volume drain passage to vary the effective flow area for controlling flow from said second control volume.

5. The injector of claim 4, wherein said additional second control volume drain passage includes a portion of said first control volume.

6. The injector of claim 1, wherein said sequencing means includes a shuttle valve.

7. The injector of claim 1, wherein said first needle valve element is telescopingly received within a cavity formed in said second needle valve element to form a sliding fit with an inner surface of said second needle valve element.

8. The injector of claim 1, further including a throttle passage formed in said second needle valve element to restrict fuel flow upstream of said first set of injector orifices during said low fuel injection rate event.

9. A closed needle injector assembly for injecting fuel into the combustion chamber of an engine, comprising:

an injector body containing an injector cavity and a plurality of injector orifices communicating with one end of said injector cavity to discharge fuel into the combustion chamber, said plurality of injector orifices including an inner set of orifices and an outer set of orifices, said injector body including a fuel transfer circuit for transferring supply fuel to said plurality of injector orifices;

an inner needle valve element positioned in said injector cavity for controlling fuel flow through said first set of injector orifices and an inner valve seat formed on said injector body, said inner needle valve element movable from a closed position against said inner valve seat blocking flow through said inner set of injector orifices to an open position permitting flow through said inner set of injector orifices;

an outer needle valve element positioned in said injector cavity for controlling fuel flow through said outer set of injector orifices and an outer valve seat formed on said injector body, said outer valve element movable from a closed position against said outer valve seat blocking flow through said outer set of injector orifices to an open position permitting flow through said outer set of injector orifices;

an inner control volume positioned adjacent an upper end of said inner needle valve element for receiving fuel;

an outer control volume positioned adjacent an upper end of said outer needle valve element for receiving fuel;

a drain circuit for draining fuel from said inner and said outer control volumes to a low pressure drain;

an injection control valve positioned along said drain circuit for controlling the flow of fuel through said drain circuit to permit movement of said inner and said outer needle valve elements between said open and said closed positions, said injection control valve movable from a closed position to an open position and from the open position to the closed position to define a control event, said injection control valve operable to create a first control event permitting movement of said inner needle valve element to the open position while maintaining said outer needle valve element in said closed position to define a low fuel injection rate event; and a sequencing device mounted on said injector body adjacent said drain circuit to permit movement of both said inner and said outer needle valve elements to respective open positions during a second control event following said first control event to define a primary fuel injection event.

10. The injector of claim 9, wherein said first and said second control events and said low fuel injection rate event and said primary fuel injection event all occur at approximately the same predetermined fuel supply pressure.

11. The injector of claim 9, wherein said sequencing device further functions for varying an effective drain flow area in said drain circuit for controlling fuel flow from said outer control volume.

12. The injector of claim 11, wherein said drain circuit includes an outer control volume drain passage, said sequencing device including an additional outer control volume drain passage to permit varying the effective drain flow area.

13. The injector of claim 12, further including a valve for controlling flow through said additional outer control volume drain passage.

14. The injector of claim 12, wherein said additional outer control volume drain passage includes a portion of said inner control volume.

15. The injector of claim 9, wherein said sequencing device includes a shuttle valve.

16. The injector of claim 9, wherein said inner needle valve element is telescopingly received within a cavity formed in said outer needle valve element to form a sliding fit with an inner surface of said outer needle valve element.

17. The injector of claim 9, further including a throttle passage formed in said outer needle valve element to restrict fuel flow upstream of said inner set of injector orifices during said low fuel injection rate event.

18. A method of injecting fuel into the combustion chamber of an engine, comprising the steps of:

providing an injector body containing an injector cavity and a plurality of injector orifices communicating with one end of said injector cavity to discharge fuel into the combustion chamber, said plurality of injector orifices including a first set of orifices and a second set of orifices, said injector body including a fuel transfer circuit for transferring supply fuel to said plurality of injector orifices;

providing a first needle valve element positioned in said injector cavity for controlling fuel flow through said first set of injector orifices and a first valve seat formed on said injector body, said first needle valve element movable from a closed position against said first valve seat blocking flow through said first set of injector orifices to an open position permitting flow through said first set of injector orifices;

providing a second needle valve element positioned in said injector cavity for controlling fuel flow through said second set of injector orifices and a second valve seat formed on said injector body, said second valve element movable from a closed position against said second valve seat blocking flow through said second set of injector orifices to an open position permitting flow through said second set of injector orifices;

providing a first control volume positioned adjacent an upper end of said first needle valve element for receiving fuel;

providing a second control volume positioned adjacent an upper end of said second needle valve element for receiving fuel;

providing a drain circuit for draining fuel from said first and said second control volumes to a low pressure drain;

providing a single injection control valve positioned along said drain circuit for controlling the flow of fuel through said drain circuit to permit movement of said first and said second needle valve elements between said open and said closed positions, said injection control valve movable from a closed position to an open position and from the open position to the closed position to define a control event;

moving said first needle valve element to the open position while maintaining said second needle valve element in said closed position during a first control event to define a low fuel injection rate event;

moving both said first and said second needle valve elements to respective open positions during a second control event following said first control event to define a primary fuel injection event.

19. The method of claim 18, wherein said low fuel injection rate event and said primary fuel injection event both occur at approximately the same predetermined fuel supply pressure.

20. The method of claim 18, further including the step of varying an effective drain flow area in said drain circuit for controlling fuel flow from said second control volume to permit the step of moving both said first and said second needle valve elements.

21. The method of claim 18, wherein said first needle valve element is telescopingly received within a cavity formed in said second needle valve element to form a sliding fit with an inner surface of said second needle valve element, further including a throttle passage formed in said second needle valve element to restrict fuel flow upstream of said first set of injector orifices during said low fuel injection rate event.

22. A closed nozzle injector assembly for injecting fuel into the combustion chamber of an engine, comprising:

an injector body containing an injector cavity and a plurality of injector orifices communicating with one end of said injector cavity to discharge fuel into the combustion chamber, said plurality of injector orifices including an inner set of orifices and an outer set of orifices, said injector body including a fuel transfer circuit for transferring supply fuel to said plurality of injector orifices;

an inner needle valve element positioned in said injector cavity for controlling fuel flow through said first set of injector orifices and an inner valve seat formed on said injector body, said inner needle valve element movable from a closed position against said inner valve seat blocking flow through said inner set of injector orifices to an open position permitting flow through said inner set of injector orifices;

an outer needle valve element positioned in said injector cavity for controlling fuel flow through said outer set of injector orifices and an outer valve seat formed on said injector body, said outer valve element movable from a closed position against said outer valve seat blocking flow through said outer set of injector orifices to an open position permitting flow through said outer set of injector orifices;

an inner control volume positioned adjacent an upper end of said inner needle valve element for receiving fuel;

an outer control volume positioned adjacent an upper end of said outer needle valve element for receiving fuel;

a drain circuit for draining fuel from said inner and said outer control volumes to a low pressure drain;

an injection control valve positioned along said drain circuit for controlling the flow of fuel through said drain circuit to permit movement of said inner and said outer needle valve elements between said open and said closed positions, said injection control valve movable from a closed position to an open position and from the open position to the closed position to define a control event, said injection control valve operable to create a first control event permitting movement of said inner needle valve element to the open position while maintaining said outer needle valve element in said closed position to define a low fuel injection rate event; and a sequencing device mounted on said injector body adjacent said drain circuit to vary an effective outlet orifice flow area in said drain circuit for controlling fuel flow from said outer control volume.

23. A method of injecting fuel into the combustion chamber of an engine, comprising:

providing an injector body containing an injector cavity and a plurality of injector orifices communicating with one end of said injector cavity to discharge fuel into the combustion chamber, said plurality of injector orifices including a first set of orifices and a second set of orifices, said injector body including a fuel transfer circuit for transferring supply fuel to said plurality of injector orifices;

providing a first needle valve element positioned in said injector cavity for controlling fuel flow through said first set of injector orifices and a first valve seat formed on said injector body, said first needle valve element movable from a closed position against said first valve seat blocking flow through said first set of injector orifices to an open position permitting flow through said first set of injector orifices;

providing a second needle valve element positioned in said injector cavity for controlling fuel flow through said second set of injector orifices and a second valve seat formed on said injector body, said second valve element movable from a closed position against said second valve seat blocking flow through said second set of injector orifices to an open position permitting flow through said second set of injector orifices;

providing a first control volume positioned adjacent an upper end of said first needle valve element for receiving fuel;

providing a second control volume positioned adjacent an upper end of said second needle valve element for receiving fuel;

providing a drain circuit for draining fuel from said first and said second control volumes to a low pressure drain;

providing a single injection control valve positioned along said drain circuit for controlling the flow of fuel through said drain circuit to permit movement of said first and said second needle valve elements between said open and said closed positions, said injection control valve movable from a closed position to an open position and from the open position to the closed position to define a control event;

moving said first needle valve element to the open position while maintaining said second needle valve element in said closed position during a first control event to define a low fuel injection rate event;

varying an effective drain flow area in said drain circuit for controlling fuel flow from said second control volume to cause movement of said second needle valve element to an open position during a second control event following said first control event to define a primary fuel injection event.

* * * * *